United States Patent [19]

Davis

[11] 4,142,720

[45] Mar. 6, 1979

[54] BILLIARD BALL

[76] Inventor: Frank E. Davis, 3103 Westador Dr., Arlington, Tex. 76105

[21] Appl. No.: 916,282

[22] Filed: Jun. 16, 1978

Related U.S. Application Data

[63] Continuation-in-part of Ser. No. 823,040, Aug. 9, 1977, abandoned.

[51] Int. Cl.[2] ..... A63B 37/02

[52] U.S. Cl. ..... 273/59 A; 273/1 M; 273/DIG. 7; 264/239

[58] Field of Search ..... 273/59 R, 59 A, 59 B, 273/1 M, 58 J, 58 A

[56] References Cited

U.S. PATENT DOCUMENTS

| | | | |
|---|---|---|---|
| 2,219,074 | 10/1940 | Guillou | 273/1 M |
| 2,655,195 | 10/1953 | Curtis | 273/1 M |
| 3,738,655 | 6/1973 | Feddick et al. | 273/59 A |
| 3,891,221 | 6/1975 | Gordon | 273/1 M |

*Primary Examiner*—George J. Marlo
*Attorney, Agent, or Firm*—Charles W. McHugh

[57] ABSTRACT

A billiard ball having magnetically attractable characteristics such that it may be utilized on pool tables where separation of a scratched cue ball from the object balls is accomplished by use of a magnet. The ball has a spherical core of non-magnetic cured resinous material, selected from the group of polyester, epoxy, polyurethane and phenolic resins; the diameter of said ball is $2\frac{1}{8}$–$2\frac{1}{4}$ inches and its weight is within the range of about 142 to 190 grams. Distributed within the core are magnetically attractable particles which are dispersed with such uniformity that the ball's anisotropy factor is not more than about 10 percent as the ball rotates about any of its axes. The preferred magnetically attractable material constitutes iron particles having a maximum size of about 0.020 inch, and ideally no larger than about −325 mesh. Another magnetically attractable filler is barium ferrite. The filler is positioned in such a way that a magnet in a table made in accordance with U.S. Pat. No. 3,362,710 (having a flux density of about 1000 gauss on its face) will attract the ball with a preferred minimum force of about 35% of the ball's weight, e.g., about 65 grams. To increase the attractive force of a magnet on a ball without increasing its weight, the particles of metallic filler may be concentrated in a spherical band near the surface of the ball. Also disclosed is a technique for casting resinous spheres in which a core is centered within a mold cavity using a plurality of small fiberglass-reinforced rods having a diameter on the order of 0.040 inch. Using such rods, a cover of polyester or the like having a thickness of about $\frac{1}{8}$ inch may be readily cast over the core—without introducing any problem of moving the ball's center of gravity away from its geometric center.

13 Claims, 6 Drawing Figures

BILLIARD BALL

Figure 1:
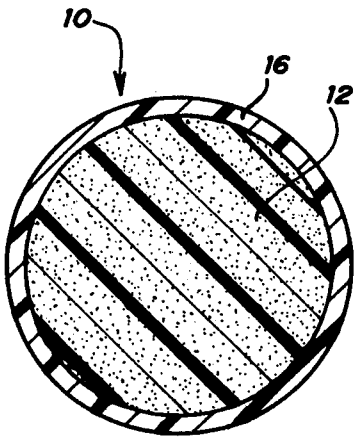

This application is a continuation-in-part of application Ser. No. 823,040, filed Aug. 9, 1977, now abandoned.

This invention relates generally to the field of billard table accessories; and more particularly it relates to a cue ball having characteristics which permit it to be separated from the object balls when said balls pass singularly along a return run within a table.

During the course of play on a billard or pool table, there are occasions when the cue ball is inadvertently dropped into one of the table's six pockets—before the end of the game. Of course, if the pool table is privately owned, there is no difficulty in recovering the "scratched" cue ball from among the numbered, object balls which have accumulated in the compartment that receives all balls which have been dropped into the pockets. In the case of commercially utilized tables, however, the old practice of simply charging a player for the amount of *time* that a table is in use has given way to charging for each game that is played—through use of coin-operated tables in which a customer deposits a certain coin in order to have access to the object balls. In such coin-operated billard tables, it is necessary that some means be provided to reliably separate a scratched cue ball from the various object balls; and, several techniques have been proposed in the past.

One of these old separation techniques involved establishing a size differential between the cue ball and the object balls, so that the object balls might be successively deposited into a locked compartment as the game progressed, while the cue ball was repeatedly returned to an open compartment everytime it was scratched. Exemplary of this type of system is that shown in 1963 U.S. Pat. No. 3,115,341 to Feddick and Wassmann. Another separation system is disclosed in U.S. Pat. No. 3,547,439 to Feddick, in which the cue ball is uniquely provided with a cluster of metallic strips embedded within the ball, so that a magnet along the side of a specially prepared run could separate the cue ball from the object balls. Still another separation technique is taught in U.S. Pat. No. 4,015,845 to Sines, wherein the cue ball contains a metallic core (preferably aluminum) which interrupts an electrical field at the desired time, in order to cause a "kicker" to propel the cue ball along a path which is different from the object balls. One other separation technique employs a weight differential, wherein the cue ball is typically heavier than the object balls—and the separation of the scratched ball by virtue of its weight alone is routinely accomplished. Regulation balls (according to the "Official Rule Book for all Pocket and Carom Billiard Games," published by the Billiard Congress of America) weigh 5 to 6 ounces, i.e., about 142 to 170 grams. The addition of 10 to 20 grams above the 170 gram weight will usually provide a sufficient differential for consistent separation using a very simple mechanical system.

While each of the above-described separation systems may well have had their own particular advantages, there was no disclosure in the prior art of how a single cue ball might be serviceable on *all* tables, regardless of the type of separation system they employ. Hence, there was no way that a supplier of cue balls could fill an order for a "cue ball" until the customer specified which kind of tables he owned, so that the type of separation system could be established. Accordingly, it is an object of this invention to provide a single cue ball which, if desired, could be fabricated in such a way that it might be reliably separated with all four of the previously described systems (i.e., separation systems based on size, weight, magnetic attraction, and electric field interference).

Another object is to provide a cue ball which is characterized by extremely accurate balance, wherein there is essentially no unequal distribution of weight about the geometric center of the ball.

Still another object is to provide improved cue balls having magnetic characteristics that are homogeneous throughout essentially the entire ball.

A further object is to provide a cue ball which may be the same diameter as the object balls but which may be reliably separated from the object balls through use of systems employing either magnetic attraction, electric field interference, or weight differential.

Figure 2:
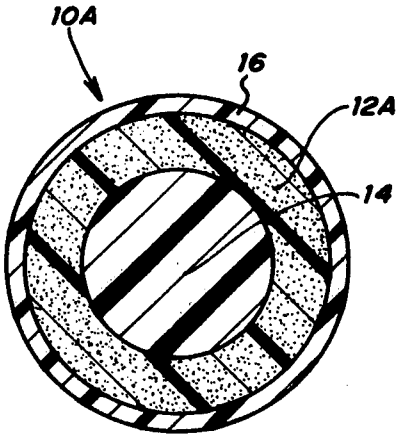

These and other objects will be apparent from a review of the specification and the claims appended thereto, as well as the drawings in which FIG. 1 is a cross-sectional view of a cue ball in accordance with the invention, having a homogeneous core with suitable magnetically attractable particles evenly distributed therethrough, and having a spherical cover of resinous or other non-oxidizing material; and FIG. 2 is a cross-sectional view of a cue ball similar to that shown in FIG. 1, except that the core is not 100% homogeneous—in that it has a central region having relatively few (if any) magnetically attractable particles and a spherical surface region containing a relatively large quantity of said particles.

Figure 3:
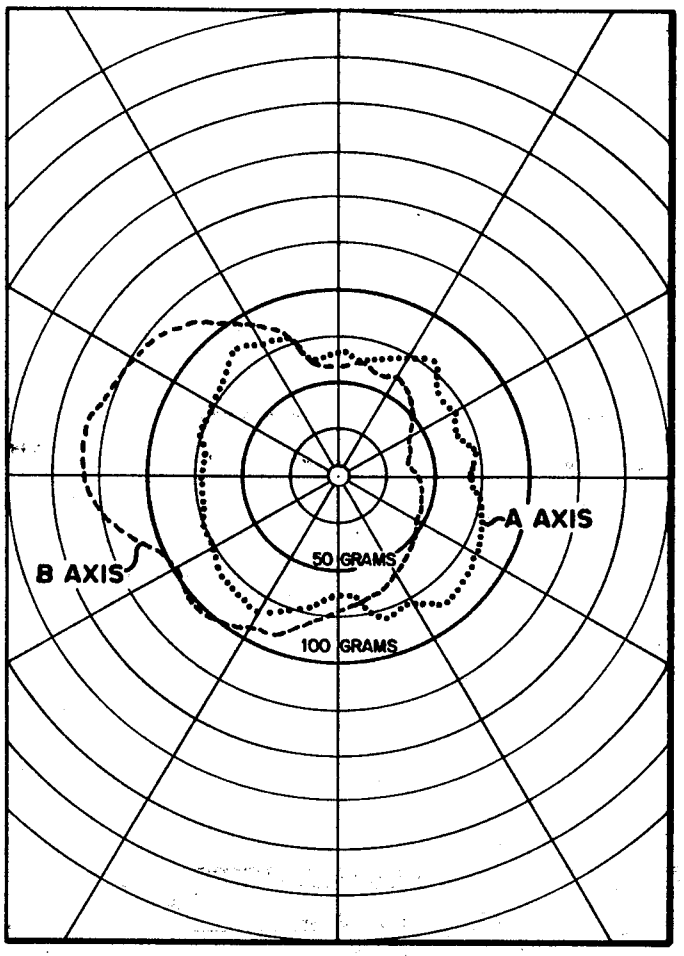
PRIOR ART FIG. 3
Figure 4:
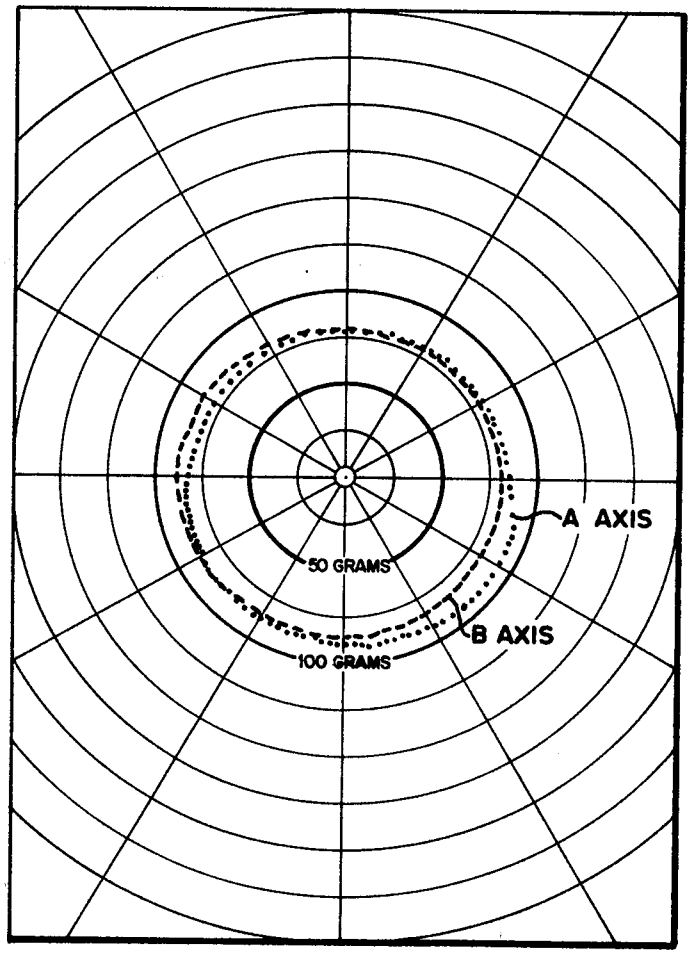
Figure 5:
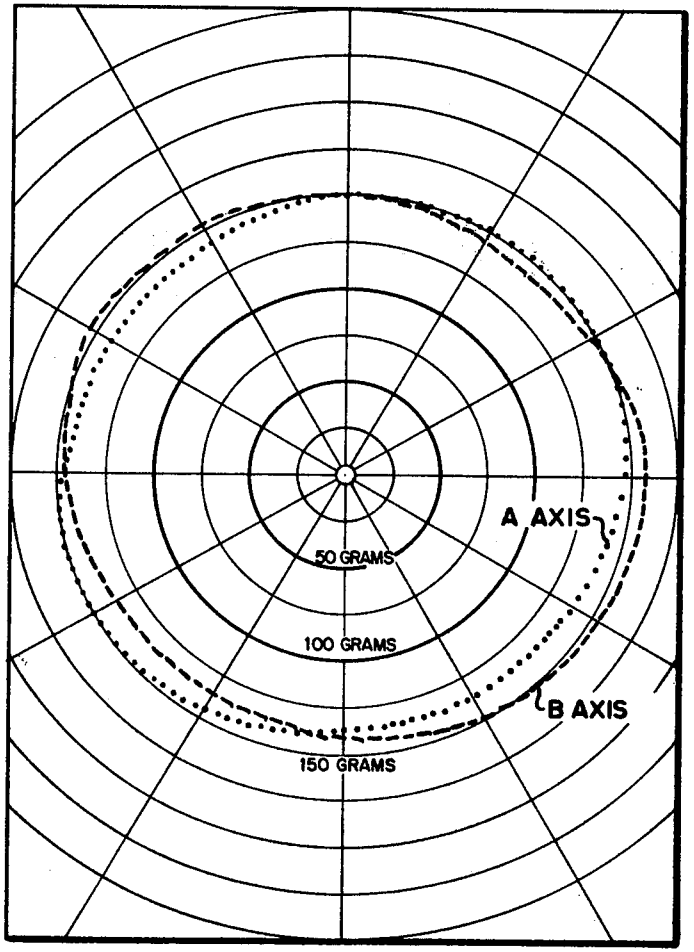

FIG. 3 is a polar diagram of the attractive forces exerted by a given magnet on an exemplary ball made in accordance with U.S. Pat. No. 3,738,655, with measurements being made about two axes that are 90° apart;

FIG. 4 is a polar diagram of the attractive forces exerted by the same magnet on an exemplary ball made in accordance with this invention; and FIG. 5 is a polar diagram of the attractive forces exerted by the same magnet on a ball constituting another embodiment of this invention in which magnetically attractable particles are concentrated near the surface of a sphere instead of being uniformly distributed therethrough.

Figure 6:
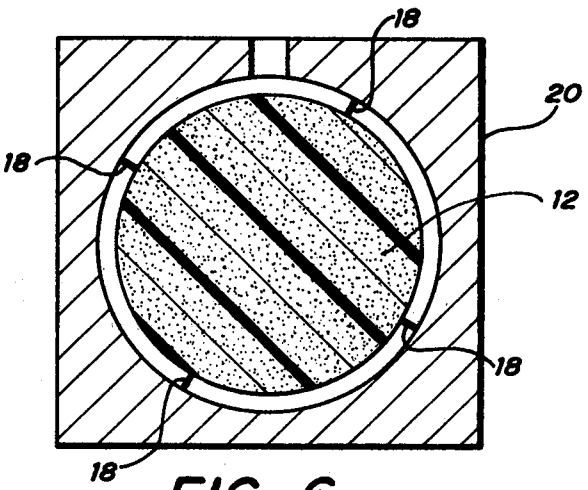

FIG. 6 is a cross-sectional, elevational view of a mold for casting billiard balls, and showing a solidified core centered in the spherical cavity of the mold prior to the time that a covering resin is poured into the mold.

Briefly, a preferred embodiment of the invention consists of a spherical core of cured resinous material in which a significant quantity of magnetically attractable particles have been uniformly distributed. For regulation-type billiard balls, the resinous material may be selected from the group including polyester, epoxy, polyurethane and phenolic resins or their equivalent. Preferably, the particles constitute iron powder having a size of 0.020 inch or less (i.e., about −50 mesh powder), with smaller particles being preferred over larger particles because the larger particles are heavier and tend to settle toward the bottom of a cavity if the resin does not set up rapidly. A cover may be put around the core, in order to preclude oxidation of any iron particles at the surface of the core. If the cover is to have any significant thickness, e.g., ⅛ inch, means are provided for centering the solidified core within a mold cavity, so as to insure that the resulting ball is dynamically balanced—by virtue of having its center of gravity coincident with its geometric center. In another embodiment, the core may be a two-piece body having a substantial quantity of iron particles near its surface and essentially none at its center. Grinding is optionally employed to establish the finished size of the balls.

Referring now to FIG. 1, a preferred embodiment of the invention is illustrated as a cue ball 10 of standard or regulation size (2⅛ or 2¼ inches in diameter) having a generally spherical core 12 of non-magnetic, cured resinous material. The core material is preferably a casting of polyester resin, although other resinous materials (such as phenolic, epoxy and polyurethane) may be serviceable. Embedded within and uniformly distributed around the core 12 are a substantial number of magnetically attractable particles which—in the embodiment of FIG. 1—are homogeneously distributed throughout the entire core. In the embodiment of FIG. 2, the particles are uniformly distributed throughout a band 12A near the surface, while a central portion 14 is devoid of said particles. The preferred particles constitute iron powder of −325 mesh, which is about as fine as commercially available talcum powder. Other magnetically attractable particles such as steel, barium ferrite and the like could also be utilized.

In both the embodiments of FIGS. 1 and 2 the metallic particles are homogeneously distributed by virtue of adding said particles to the resinous material before it is cured, and achieving a thorough mixture of the liquid resin and the metallic particles, taking care to insure that no air bubbles are left in the material just prior to the time that it hardens. In order to foster the homogeneous distribution of metallic particles in the cores 12, 12A, it is advantageous that the particles be relatively small; but larger particles can still be effectively suspended within certain liquid resins. Perhaps it should be mentioned, however, that larger particles may tend to settle to the bottom of a casting if the cure time is too long, or if the resin has a very low viscosity.

The quantity of metallic particles contained within the core 12 or 12A will typically be based upon two principal considerations: the desired weight of the contemplated cue ball, as the desired magnetic attractability of the cue ball. With regard to its weight, it is possible with this invention to create a ball whose weight is about the same as regulation balls (5½ to 6 oz. for pocket billiard and 5 to 5½ oz. for snooker balls). It would also be possible to make a ball which is heavy enough so that the ball might be utilized on those coin-operated pool tables which separate a scratched cue ball from the object balls by virtue of a difference in weight. In view of the fact that object balls typically weight no more than 170 grams, those separation systems which relay on weight frequently utilize a cue ball that weighs 185 grams. If 190 grams is the nominal value for a cue ball's weight, a certain amount of manufacturing variance can be permitted and the reliability of cue ball separation will still be satisfactory. By weight, the amount if iron filler which is embedded in a polyester core 12 can be about 80 to 90 grams, which provides a filler-to-resin ratio of about 3:2 in the preferred embodiment. With about 85 grams of iron powder within the core 12, the cue ball disclosed herein will be reliably attracted with a force of at least 75 grams to a magnet having a strength of about 1000 gauss; this is enough to essentially guarantee that the ball will not fall away from a horizontally positioned magnet alongside the trough in which the balls roll after they have been dropped into one of the table's pockets. Accordingly, the cue ball disclosed herein will operate satisfactorily on those "magnetic" tables which are manufactured by Valley Manufacturing Company of Bay City, Mich. in accordance with the teachings of U.S. Pat. No. 3,362,710 to Feddick and Wassmann. Additionally, the metallic particles within the core 12 are adequate to produce separation in an apparatus constructed in accordance with the teachings of U.S. Pat. No. 4,015,845 to Sines, which relies on interruption of an electrically produced field rather than magnetism, per se.

While it is the metallic particles embedded within the core 12 which give the ball characteristics such that it can be reliably separated from the object balls, those same particles (if they are made of iron) will oxidize if they are exposed to air for an extended period of time. Accordingly, it is highly advantageous to provide a smooth, continuous cover 16 of non-oxidizing material around said core 12. The cover 16 can be of the same material as the core 12, such as polyester, or it can be made of many other petroleum derivatives, including epoxy, polyurethane, etc. In the preferred embodiment, the outer diameter of the cover 16 is approximately the same as the nominal diameter of the object balls which are to be struck by the cue ball; but, if desired, the diameter could be slightly greater or smaller than the object balls, in order to foster separation of the cue ball from the object balls by virtue of a size differential. The thickness of a non-magnetic polyester cover 16 will typically be no more than about ⅛ inch, which offers a satisfactory compromise between a desire to have metallic particles relatively near the surface of the cue ball while still having a cover that is thick enough to guard against any fracture as a result of dynamic loads which may be placed on the ball. Those dynamic loads can sometimes be rather large, and they arise when a ball is accidentally dropped by a pool player on a hard floor, as well as when the cue ball routinely strikes another ball during a game.

Turning next to the method of preparing a magnetically attractive billiard ball, it will first be assumed (in this example) that the resinous material to be employed is a polyester resin. Polyester is a particularly convenient and economical material for making billiard balls, although there are some persons who think that phenolic balls have superior characteristics with regard to resistance to abrasion and/or wear under conditions of harsh use. Assuming that the ball is to have a completely solid and homogeneous core—and only a thin cover, a uniform suspension of magnetically attractable particles within the liquid resinous material is initially prepared. A pigment such as titanium dioxide may also be used, if desired, to render the ball white. For a finished cue ball which is to be 2¼ inches in diameter and weigh approximately 190 grams, about 57 grams of polyester are blended with about 86 grams of −325 mesh iron powder. The iron powder, which has essentially the consistency of talcum powder, will mix quite readily with the liquid polyester—which typically has the consistency of maple syrup. Iron particles larger than −325 mesh can also be used, but such larger particles have a tendency to settle to the bottom of a container (in response to gravity) after an extended period of time. Accordingly, it is believed that the magnetically susceptible particles should have a diameter no larger than about 0.020 inch in order to preclude undesirable settling of the particles.

One technique for precluding the undesirable settling of iron particles to the bottom of a container is to add a thickening agent to the mixture of liquid resin and magnetically attractable particles. A preferred thickening agent is fumed amorphous silicon dioxide, such as that manufactured by Cabot Corporation and sold under the trademark Cab-o-sil. In the example given above, a quantity of about 2 grams of fumed silica is sufficient to render the blend so stable that the iron particles will remain uniformly suspended throughout the liquid resin almost indefinitely. Putting too much thickening agent into the polyester resin would obviously be self-defeating, though, if the resin is to be subsequently transferred into a mold by pouring. Accordingly, for routine casting operations care should be taken to insure that the resulting mixture still has enough fluidity to be poured into a mold. In general, it is believed that a thickening agent such as fumed silica should comprise no more than about 10 percent of the resinous constituent. Other thickening agents, such as wheat flour, etc., could be used, of course; and the percentage of a different thickening agent might vary somewhat from the optimum value given herein for fumed silica.

Once a uniform blend of resin, iron prticles, and (optionally) a thickening agent has been achieved, a catalyst for the resin is added to start the cure cycle, and the blend is poured into a spherical mold or cavity and allowed to solidify. With polyester and a catalyst such as MEKP, the curing time can be adjusted so that the core can be removed from the mold in about 1 hour. Because polyester resins tend to shrink by a small amount when they harden, it is generally desirable to provide a sprue above the mold, so that some excess resin may be available to compensate for the small amount of inherent shrinkage. This sprue, once hardened, is simply cut off near the surface of the sphere, and any remaining stub is ground so as to be flush with the remainder of the spherical surface.

As for the diameter of the spherical body fabricated in accordance with the above recitation, it may be substantially any desired size, including an exact 2¼ inches or somewhat more or less. If the magnetically attractable particles are iron particles, those exposed particles at the surface of the body may rust (oxidize); and, if the long-term cosmetic appearance of the ball is important, the possibility of rusting may dictate that a protective cover should be added to the spherical body. Most any air-impervious cover would do the job of preventing rust, but petroleum distilates and waxes are perhaps easiest to apply. A polyester cover with a thickness of about ⅛ inch prevents any offensive rusting and also insures sufficient structural integrity to preclude cracking of the protective cover during normal play on a billiard table. Alternatively, a protective cover of phenolic or some other material may be added over the exterior surface of the resinous core.

Several techniques may be employed to provide a protective cover over the core of a ball. One technique is to position the core within the center of a spherical mold, and then pour a casting resin around the core. This can be accomplished by providing at least four spacers which are affixed to the core at four widely separated points on the surface of the core. Spacers which are in the form of relatively small fiberglass rods can be enveloped by the resin which is to become the protective cover, such that the fiberglass rods will become a permanent part of the finished ball. As long as the fiberglass rods are very small, e.g., about 0.040 inch in diameter, then the encapsulation of the spacer rods within a ball does not harm either the ornamental appearance of the ball or its playing characteristics.

Before the resin for the protective cover is poured into the space between a core and a mold cavity, it is advisable to prepare the surface of the core in such a way that the new resin will strongly adhere to the solidified core. Of course, the extent to which this preparation step may be advisable will depend to a certain extent upon the amount of any mold release compound that may have been left on the core after it was removed from its mold. One convenient way of both cleaning and scuffing the surface of a large number of cores is simply to place them in the drum of an industrial tumbler, along with some abrasive material, and rotate the drum for several minutes. Such a process removes the glaze that may exist on the cores (as a result of the mold release), and slightly roughens the surface of the cores. A mechanically roughened surface of a core is advantageous in that any broken molecules at the core's surface will more readily bond to the protective cover which is subsequently cast around the core.

In order to better understand the present invention, it will perhaps be advantageous to discuss the differences between a cue ball made in accordance with this invention and a cue ball made in accordance with U.S. Pat. No. 3,738,655 to Feddick and Wassmann (the closest known commercially available ball which serves some of the functions that are served by the instant ball). Initially, it seems appropriate to mention that a ball made in accordance with the present invention will have a much greater magnetic uniformity (isotropy), because its core is substantially homogeneous. Cue balls made like that shown in FIG. 5 of U.S. Pat. No. 3,738,655 are inherently anisotropic because of the internal metal loops forming a "cage" which is obviously not continuous. While even an uninitiated person might suspect that there could be at least some difference in magnetic uniformity between balls of these two designs, the amount of the difference seems to be quite surprising. For comparison purposes, three different commercially available balls in accordance with the U.S. Pat. No. 3,738,655 were purchased and carefully examined and measured. The anistropy factor, Δ, for each of the three balls was measured and found to be 62.4%, 26.2% and 24.9%. This anisotropy factor was calculated in accordance with the formula $$\Delta = \frac{\text{Max } F_M - \text{Min } F_M}{\text{Max } F_M + \text{Min } F_M} \times 100\%$$

wherein Max $F_M$ is the value of the attractive force exerted by a given magnet on a ball in contact with the magnet, with the ball having an orientation to maximize its attraction to the magnet, and Min $F_M$ is the value of the attractive force exerted by the same magnet on the ball, with the ball being in contact with the magnet and having an orientation such that its attraction to the magnet is minimized. Of course, a low anisotropy factor would indicate that the tested ball is more nearly homogeneous and has more nearly uniform properties than would a ball with wide variation in its magnetic attractability. While the three balls, U.S. Pat. No. 3,738,655 had respective anisotropy factors of 62.4%, 26.2% and 24.9%, it is significant that three randomly selected balls made in accordance with this invention had anisotropy factors of less than 10%, namely 9%, 7.5% and 8.2%. From a comparison of these values, it should be quite apparent that there is a greater uniformity in the magnetic properties of a ball made in accordance with this invention.

While the physical characteristics of a U.S. Pat. No 3,738,655 ball and a ball of this invention are obviously quite different, a reasonable question is how will this difference likely affect actual play on a billiard table. To find the answer to such an inquiry, a comparative test was run with two balls, both of which were attracted to a U.S. Pat. No. 3,362,710 magnet with a median force of about 74.5 grams. The first ball which was tested was the previously mentioned U.S. Pat. No. 3,738,655 ball having an anisotropy factor of 24.9%. The second ball which was tested was made in accordance with FIG. 1 of this disclosure, and it has an anisotropy factor of 8.2%. Each ball was allowed to roll 100 times through the segregating mechanism of a U.S. Pat. No. 3,362,710 table, with the balls being alternated so as to eliminate any progressive error which might affect the test results. And, a layer of masking tape was put over the magnet to simulate the buildup of dirt and the like—and poor adjustment of the magnet, which sometimes attend the prolonged commercial use of a table. The number of times that a respective ball broke away from the holding magnet and fell into the trough of object balls was then recorded. The number of unwanted falls (out of 100 tests) for the U.S. Pat. No. 3,738,655 ball was a surprisingly high 23, while the ball made in accordance with FIG. 1 did not fall away from the magnet a single time. From these results, it can realistically be postulated that a ball having an anisotropy factor of no more than 10% would give greater reliability in a U.S. Pat. No. 3,362,710 table than would balls having greater anisotropy. And, having demonstrated that it is possible to make billiard balls whose anisotropy factor does not exceed 10% as the ball rotates about any of its axes, it is believed that such a value should now be accepted as a realistic standard for the industry.

Referring next to FIGS. 3, 4 and 5, these are plots of the magnetic forces of attraction exerted on three balls by a given magnet of the type found in pool tables made in accordance with U.S. Pat. No. 3,362,710. Such magnets are channel magnets (oriented for magnetization as a "U") made of cast Alnico 5, and have a flux density of about 1000 gauss on the faces. They are manufactured by Indiana General, and are adequately represented by FIG. 9 of the U.S. Pat. No. 3,362,710.

Looking initially to FIG. 3, which is a plot of the forces (in grams) for a commercially available ball made in accordance with the U.S. Pat. No. 3,738,655, it will be seen that the attractive force on the ball varied widely as the ball was rotated about a first axis. In order to eliminate any effect of measurement about that one axis, the ball was turned 90° and then again rotated through 360°, with new measurements being recorded around a great circle as the ball was rotated. It will be seen that there is a wide variation in the attractive forces between the ball and the magnet, ranging from 37 grams to 137 grams. Since the magnet is static and does not change during any part of a test, it is obvious that any variation in the attractive forces must come from a difference within the ball; and, since the resinous material is non-magnetic, the variation seen in FIG. 3 can only be attributable to the metallic insert in the ball.

In contrast to the results obtained with a U.S. Pat. No. 3,738,655 ball, FIG. 4 shows results obtained with a ball made in accordance with this invention and having a substantially uniform core of resinous material and discrete iron particles distributed therethrough. It will be seen that the holding force of the U.S. Pat. No. 3,362,710 magnet is a nearly uniform 80 grams, which is about 40% of the total weight of the ball. Similar results are shown in FIG. 5 with a ball having an equivalent quantity of iron particles, but having them concentrated closer to the surface of the ball—by virtue of placing within the core an insert that has essentially no magnetic particles therein. Obviously, concentrating the metallic particles in a band near the surface of the ball will make it easier for the magnet to act on them. And, making any protective cover very thin will also increase the interaction between segregating means (whether it uses a permanent magnet, electromagnetic field, etc.) and any metallic particles in the body of the cue ball.

Perhaps the greatest significance of a variation in the isotropy of cue balls is the reliability of separation of the cue ball from the object balls as it rolls along a trough in a pool table made in accordance with the U.S. Pat. No. 3,362,710. If the magnet is just barely strong enough to hold a rolling cue ball of the U.S. Pat. No. 3,738,655 design so as to usually prevent it from falling into the tray for object balls, it frequently happens that the random orientation of the cue ball causes it to present a "weak" side to the magnet. When this happens, the magnet is not strong enough to hold the ball; it then falls into the locked compartment along with the object balls.

A person who was exposed to the above-described problem for the first time might be inclined to suggest a cure of simply using a stronger magnet. However, this over simplistic solution has two drawbacks: first, a more powerful magnet will typically cost more money, which naturally increases the cost of the final product or reduces the profit to the table manufacturer. For example, to replace the Alnico 5 channel magnet which comes as standard equipment in a table manufactured by Valley Manufacturing Company (in accordance with the U.S. Pat. No. 3,362,710) with a magnet having 25% greater holding force would increase the cost of the magnet by 45%. Secondly, there is the possibility that such an extrastrength magnet will have such a significant attraction on the "strong" side of a U.S. Pat. No. 3,738,655 ball as to bring it to a halt, instead of letting it roll slowly to its intended tray. If a cue ball should become magnetically "locked" to the separation magnet, or it improperly drops away from the magnet into the tray for object balls, play on the table must be suspended until a serviceman arrives to unlock a door for retrieving the "lost" cue ball. If the player is content to wait passively for a serviceman, then the only financial loss incurred by the owner of the table is the income that would have been generated if the table had been in continuous use. It is a fact of life, however, that some persons get rather belligerent when machines do not function properly and they fail to render the goods or services they are supposed to. With coin-operated billiard tables, unhappy customers who have "lost" a cue ball have been known to vent their frustration on the entire table, sometimes causing enough damage as to render it beyond salvage. Since patience is a virtue which is very difficult to instill in unwilling customers, the owner of a coin-operated pool table can best protect his investment by having reliable ball separation equipment, including cue balls having essentially uniform isotropic characteristics.

With regard to the preferred material which is employed in the balls of FIGS. 1 and 2, both polyester and phenolic resins are commercially used in billiard balls;

and polyester is believed to be the most desirable resin for use in accordance with this invention. It is preferred because it is easy to use in casting balls, it is economical, and it has a long shelf life; and, balls made from it have more than adequate resistance to abrasion, as well as excellent resistance to discoloration and impact. But, for those who have the opinion that only phenolics constitute suitable materials for billiard balls, the steps decribed herein can satisfactorily be utilized with phenolics. It is true, though, that the curing agent for phenolic resins usually reacts in an unfavorable manner with metallic particles; so, one of the well-known techniques for coating metallic particles should be employed if the resinous material is to be phenolic. Also, it is recognized that certain practical trade-offs may be made between the coating of billiard ball (in order to render it non-oxidizing) and the expense to apply said coating. Low-cost coatings of carnauba or other wax, etc., would obviously be effective to prevent the metallic particles on the ball's surface from oxidizing; but, such soft coatings can eventually wear off, while a phenolic coating might last almost indefinitely.

An additional trade-off may be made between either placing the magnetically attractable material homogeneously throughout the ball or concentrating it near the surface. A ball having a homogeneous body will obviously be easier to prepare than will a ball having a central portion which is devoid of metallic particles. This is because fewer production steps are required in making an essentially homogeneous body. On the other hand, concentrating the metallic particles near the surface will permit a reduced quantity of such particles to be used—without affecting the sensitivity of the ball-separating means. For example, a ball having as little as 40 grams of iron particles concentrated in a spherical band near the surface has been manufactured, and its performance is at least as good as a ball having 90 grams uniformly distributed throughout the body. Of course, the thickness of any non-metallic cover over the metallic particles will also have some influence on the interaction between a ball-separating means and the metallic particles. To enhance the "active" characteristics of any metallic particles in a body, the thickness of an insulative cover should naturally be kept as small as practicable.

While only a few specific embodiments of the invention have been disclosed in great detail herein, it should be apparent to those skilled in the art that modifications thereof can be made without departing from the spirit of the invention. For example, it is not mandatory that the core of a multi-part ball be geometrically centered with a plurality of radially embedded rods—as long as the resulting ball is dynamically balanced. So any satisfactory fabrication technique that achieves the desired results should be understood to be completely acceptable. Too, the billiard balls may be given a nominal size and weight for regulation play in pocket billiards (with a weight of 5½ to 6 ounces and a diameter of 2¼ inches) or snooker (with a weight of 5 to 5½ ounces and a diameter of 2⅛ inches). And, to the extent that a particular need might justify some deviation from regulation size or weight, the principles disclosed herein are readily adaptable for creating a billiard ball with most any reasonable characteristics. Thus, the specific structures shown herein are intended to be exemplary, and are not meant to be limiting—except as described in the claims appended hereto.

What is claimed is:

1. A billiard ball adapted for playing either pocket billiards or snooker and having magnetically attractable characteristics such that it may be utilized on pool tables where separation of a scratched cue ball from the object balls may be accomplished by use of a magnet, comprising:

a spherical ball of non-magnetic cured resinous material, with the nominal diameter of said ball being within the range of 2⅛ to 2¼ inches and the weight being within the range of 142 to 190 grams, and said ball having magnetically attractable material distributed throughout the ball with such uniformity that its anisotropy factor is not more than 10 percent as the ball rotates about any of its axes.

2. The billiard ball as claimed in claim 1 wherein the cured resinous material is polyester, and the magnetically attractable material constitutes iron particles.

3. The billiard ball as claimed in claim 2 wherein the iron particles have a maximum size of 0.020 inch.

4. The billiard ball as claimed in claim 1 and further including a smooth, continuous cover of non-oxidizing material covering a central body, with the outer diameter of said cover being essentially 2¼ inches.

5. The billiard ball as claimed in claim 4 wherein said cured resinous material in the body is a polyester material, and the cover around said body is also a polyester material.

6. The billiard ball as claimed in claim 4 wherein the thickness of the non-oxidizing cover is about ⅛ inch.

7. The billiard ball as claimed in claim 1 wherein said magnetically attractable particles constitute barium ferrite.

8. The billiard ball as claimed in claim 1 wherein said magnetically attractable particles are uniformly distributed throughout essentially all of the body of said ball.

9. The billiard ball as claimed in claim 1 wherein most of said magnetically attractable particles are concentrated near the surface of said ball, and the central region of said ball contains proportionately less particles than does its surface region.

10. The billiard ball as claimed in claim 1 wherein the magnetically attractable particles weigh essentially 40–90 grams.

11. The billiard ball as claimed in claim 1 wherein said magnetically attractable particles constitute discrete iron particles having a maximum size of 0.003 inch.

12. The billiard ball as claimed in claim 1 and further including a plurality of widely spaced rods embedded in the ball, each of which rods extends in a radial direction with respect to the ball and each of which terminates at the surface of the ball, with said rods being functional to insure that a core is geometrically centered within the ball.

13. The billiard ball as claimed in claim 12 wherein the rods are made of fiberglass and have a diameter of about 0.040 inch.

* * * * *